United States Patent [19]

House

[11] 3,998,196

[45] Dec. 21, 1976

[54] IGNITION DISTRIBUTOR

[75] Inventor: Ronnalee House, Anderson, Ind.

[73] Assignee: General Motors Corporation, Detroit, Mich.

[22] Filed: July 16, 1975

[21] Appl. No.: 596,387

[52] U.S. Cl. ..... 123/146.5 A; 200/19 DC; 200/19 DR; 200/26; 200/153 P

[51] Int. Cl.[2] ..... H01N 19/12

[58] Field of Search ..... 123/146.5 A; 200/26, 200/19 DC, 19 DR, 153 P, 280, 286, 275, 277

[56] References Cited

UNITED STATES PATENTS

| | | | |
|---|---|---|---|
| 2,427,583 | 9/1947 | Von Mertens | 200/153 P |
| 3,423,555 | 1/1969 | Preux | 200/153 P |

FOREIGN PATENTS OR APPLICATIONS

| | | | |
|---|---|---|---|
| 2,144,860 | 3/1973 | Germany | 123/146.5 A |

*Primary Examiner*—Harold W. Weakley
*Attorney, Agent, or Firm*—Richard G. Stahr

[57] ABSTRACT

An ignition distributor wherein a movable output electrical contact having at least two diametrically opposed tip portions is mounted upon the distributor rotor at a location at which it is revolved by the rotor through a circular path about the axis of the distributor shaft. As the movable electrical contact is revolved by the rotor, it is rotated about its axis through driving gearing and is so arranged that, as it is rotated by the driving gearing, each successive one of the tip portions is rotated into electrical circuit relationship with the next successive one of the distributor output terminals and the diametrically opposed tip portion is rotated into electrical circuit relationship with the distributor input terminal.

5 Claims, 4 Drawing Figures

IGNITION DISTRIBUTOR

This invention is directed to ignition distributors, and, more specifically, to an ignition distributor of the type which has a movable output electrode having a plurality of diametrically opposed output tip portions which is simultaneously revolved about the axis of the distributor shaft and rotated about its own axis.

Future internal combustion engine ignition systems for motor vehicles may be required to deliver higher ignition spark energy with longer burn time, possibly 40,000 volts as opposed to the 20,000 to 30,000 volts of present systems, to enable the firing of much wider gap spark plugs. Experimentation with this high ignition spark energy has exposed severe insulation problems within the distributor cap as a result of the high voltage and the requirement of a longer period of time that the output movable electrode is in electric circuit. relationship with each of the distributor output terminals because of the required longer burn time.

It is, therefore, an object of this invention to provide an improved internal combustion engine ignition distributor.

It is another object of this invention to provide an improved internal combustion engine ignition distributor which provides improved insulation barriers between each of the distributor terminals and a longer period of time for the output movable electrode to be in electrical circuit relationship with the distributor input terminal and each of the stationary distributor output terminals.

It is a further object of this invention to provide an improved internal combustion engine ignition distributor in which the movable output electrical contact is revolved about the axis of the distributor shaft and has diametrically opposed output tip portions so arranged that, as the movable contact is revolved, each successive one of the tip portions thereof is rotated into electrical circuitry relationship with the next successive one of the distributor output terminals and the diametrically opposed tip portion is rotated into electrical circuit relationship with the distributor input terminal.

In accordance with this invention, an improved ignition distributor is provided wherein the movable output electrical contact having at least two diametrically opposed output tip portions is rotatably mounted upon the distributor rotor at a location at which it is revolved by the rotor through a circular path about the axis of the distributor shaft and, simultaneously, is rotated about its axis by a driving arrangement and is so arranged that each successive one of the tip portions thereof is rotated into electrical circuit relationship with the next successive one of the distributor output terminals and the diametrically opposed tip portion is rotated into electrical circuit relationship with the distributor input terminal.

For a better understanding of the present invention, together with additional objects, advantages and features thereof, reference is made to the following description and accompanying drawings in which.

Throughout the several FIGURES of the drawing, like elements have been assigned like characters of reference.

Figure 1:
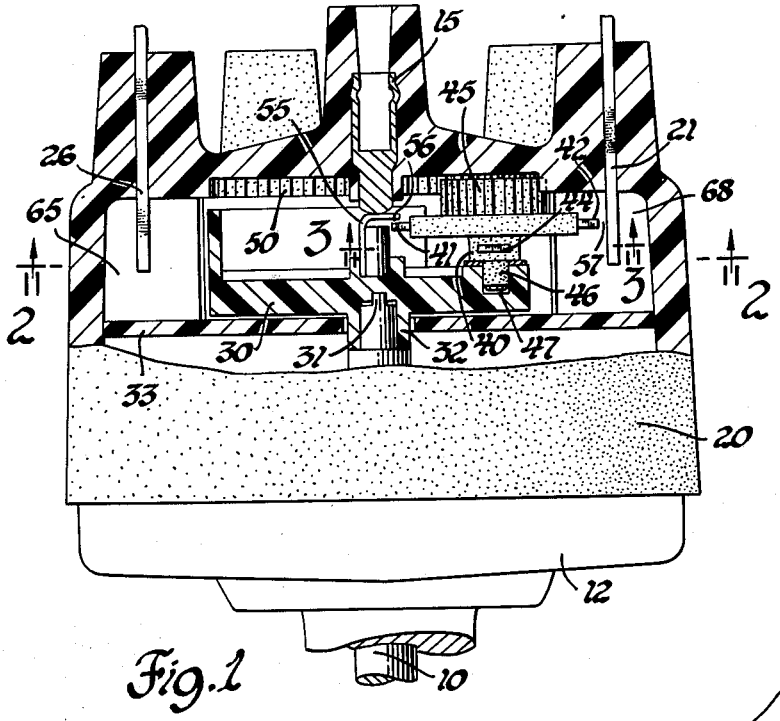
FIG. 1 is a side elevational view, partially in cross-section, of the ignition distributor of this invention.

In the interest of reducing drawing complexity and since internal combustion engines, ignition coils and internal combustion engine spark plugs are well known in the automotive art and, per se, form no part of this invention, these items have not been shown in the drawing.

Figure 3:
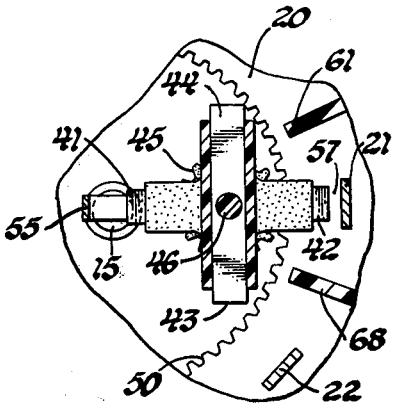
FIG. 3 is a section view of FIG. 1 taken along line 3—3 and looking in the direction of the arrows.
Figure 2:
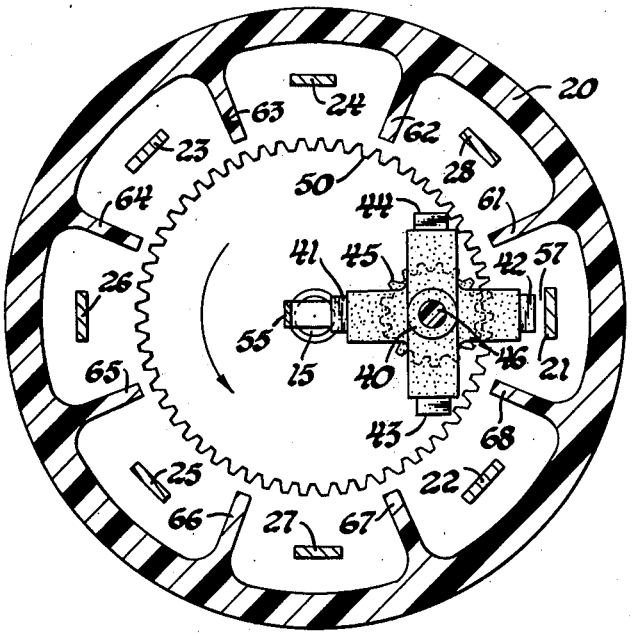
FIG. 2 is a section view of FIG. 1 taken along line 2—2 and looking in the direction of the arrows.
Figure 4:
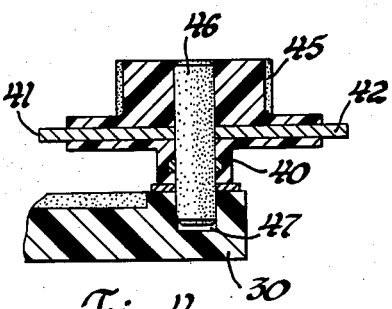
FIG. 4 is a side elevation view in section of a portion of the ignition distributor of this invention.

FIGS. 1 through 3 of the drawing set forth the ignition distributor of this invention for sequentially directing the ignition spark energy produced by an ignition coil to the spark plugs of an associated internal combustion engine.

A distributor shaft member 10 is journaled for rotation within a distributor bell or base member 12 in timed relationship with the associated internal combustion engine in a manner well known in the automotive art. As also is well known in the automotive art, an internal combustion engine ignition distributor is provided with an input circuit terminal 15 to which one end of the ignition coil secondary winding is connected and a plurality of output circuit terminals, each corresponding to one of the spark plugs of the associated internal combustion engine. In FIGS. 1 and 3, these output circuit terminals for an associated 8-cylinder internal combustion engine are referenced by the numerals 21 through 28, inclusive, with the second numeral designating the cylinder number. That is, output circuit terminal 21 corresponds to the spark plug of engine cylinder No. 1, output circuit terminal 22 corresponds to the spark plug of engine cylinder No. 2, and so forth. Without intention or inference of a limitation thereto, the plurality of output circuit terminals 21 through 28, inclusive, may be supported by the distributor cap 20 in a circumferential arrangement, as best seen in FIG. 2, and the input circuit terminal 15 may be supported by the distributor cap 20 at the center of the circumferentially arranged output circuit terminals. It is to be specifically understood that alternate methods of supporting the distributor input and output circuit terminals may be employed without departing from the spirit of this invention.

A rotor member 30 of an insulating material is mounted upon and arranged to be rotated by shaft member 10 in timed relationship with the associated internal combustion engine in the manner well known in the art. Without intention or inference of a limitation thereto, a key 31 on the top of shaft member 10 may engage a slot at the bottom of the hub portion 32 of rotor member 30. A retainer plate 33 of an insulating material may be press fit into cap 20 for the purpose of maintaining the rotor assembly in the cap and to provide insulation between the high voltage input and output terminals and the metallic parts of the distributor such as the shaft and so forth.

A movable electrical output contact having at least two diametrically opposed output tip portions is rotatably mounted upon rotor member 30 at a location at which it is revolved by rotor member 30 through a circular path about the axis of shaft member 10 as rotor member 30 is rotated by shaft member 10. In FIGS. 1, 2 and 3, the movable electrical contact is illustrated as having two pairs of diametrically opposed tip portions 41–42 and 43–44. The movable electrical contact may be supported by a hub member 40 having external teeth 45 in the form of a spur gear. The hub and movable contact assembly is mounted for rotation about pin 46 which is located within an accommodating bore 47 in rotor member 30. With this arrangement, the movable electrical contact is revolved by rotor member 30 through a circular path about the longitudinal axis of shaft member 10 when rotor member 30 is rotated by shaft member 10 and the associated internal combustion engine. The driving arrangement for rotating the movable electrical contact about its axis while it is revolved about the axis of shaft 10 may be an internal ring gear 50 supported by cap member 10 and in driving engagement with spur gear 45. In the drawing, ring gear 50 is shown to be molded into the cap, however, it is to be specifically understood that a separate ring gear supported by cap member 20 may be employed without departing from the spirit of the invention. As illustrated in the drawing, the teeth of internal ring gear 50 are in driving engagement with the teeth 45 of hub member 40. Consequently, when the movable electrical contact and hub assembly is revolved about the axis of shaft member 10 by rotor member 30, the movable electrical contact and hub assembly is rotated about pin 46. The movable electrical contact is so arranged that, as it is rotated by the driving arrangement, each successive one of the tip portions thereof is rotated into electrical circuit relationship with the next successive one of the distributor output circuit terminals 21 through 28, and the diametrically opposed tip portion is rotated into electrical circuit relationship with the distributor input terminal 15. Carried by rotor member 30 is a spring member 55 of an electrically conductive material which is in rubbing electrical contact with the lower arcuate portion of distributor input circuit terminal 15, as best illustrated in FIG. 1. As best illustrated in FIG. 1, each of the tip portions 41 through 44 of the movable electrical contact is passed in arc gap relationship with spring member 55, the arc gap being referenced by the numeral 56, and the diametrically opposed output tip portion is passed in arc gap relationship with each of the distributor output terminals 21 through 28, the arc gap being referenced by the numeral 57. With the movable electrical contact in the position as illustrated in the drawing, the ignition spark energy produced by the ignition coil is conducted through input circuit terminal 15, spring member 55, arc gap 56 between spring member 55 and tip portion 41 of the movable electrical contact, tip portion 42 of the movable electrical contact, arc gap 57 and output terminal 21 and the interconnecting spark plug leads to the spark plug of engine cylinder 1.

Assuming for purposes of this specification, and without intention or inference of a limitation thereto, that the movable electrical contact and hub assembly is revolved about the longitudinal axis of shaft member 10 by rotor member 30 in a counterclockwise direction, as illustrated by the arrow in FIG. 2. Initially, the ignition spark energy is conducted from the distributor input circuit terminal 15 through spring member 55, arc gap 56, tip portion 41, tip portion 42 and arc gap 57 to distributor output terminal 21. As the movable electrical contact in the hub assembly is revolved by rotor member 30, the movable electrical contact is rotated about pin 46, consequently, diametrically opposed tip portions 44 and 43 are next rotated into electrical circuitry relationship with distributor output circuit terminal 28 and distributor input circuit terminal 15, respectively; diametrically opposed tip portions 41 and 42 are next rotated into electrical circuit relationship with distributor output circuit terminal 24 and distributor input circuit terminal 15, respectively; diametrically opposed tip portions 43 and 44 are next rotated into electrical circuit relationship with distributor output circuit terminal 23 and input circuit terminal 15, respectively; diametrically opposed tip portions 42 and 41 are next rotated into electrical circuit relationship with distributor output circuit terminal 26 and input circuit terminal 15, respectively; diametrically opposed tip portions 44 and 43 are next rotated into electrical circuit relationship with distributor output circuit terminal 25 and input circuit terminal 15, respectively; diametrically opposed tip portions 41 and 42 are next rotated into electrical circuit relationship with distributor output circuit terminal 7 and input circuit terminal 15, respectively; diametrically opposed tip portions 43 and 44 are next rotated into electric circuit relationship with distributor output circuit terminal 22 and input circuit terminal 15, respectively; and diametrically opposed tip portions 42 and 41 are next rotated into electrical circuit relationship with distributor output circuit terminal 21 and input circuit terminal 15 and the process is repeated as rotor 30 is revolved. From this description, it is apparent that the ignition spark energy is successively directed to distributor output circuit terminals 21, 28, 24, 23, 26, 25, 27 and 22 which is the normal firing order of an 8-cylinder internal combustion engine, 1-8-4-3-6-5-7-2. That is, the distributor of this invention sequentially directs the ignition spark energy produced by the ignition coil to the spark plugs of an associated internal combustion engine.

Because of the gear reduction between ring gear 50 and spur gear 45, each of the tip portions of the movable electrical contact is maintained in electrical circuit relationship with the respective ignition distributor output terminals for a much longer period of time than is the output tip of the movable contact of a conventional distributor which is swept by each of the ignition distributor output circuit terminals at the speed of rotation of the rotor member. Furthermore, this arrangement permits much longer insulation webs 61 through 68, inclusive, between each of the output circuit terminals for eliminating the possibility of an arc-over between input circuit terminal 15 and an unwanted one of the output terminals.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. An internal combustion engine ignition distributor for sequentially directing ignition spark energy produced by an ignition coil to the spark plugs of an associated internal combustion engine comprising: a base member, a shaft member rotatably supported by said base member, a plurality of output terminals, each corresponding to a respective spark plug of said associated internal combustion engine supported in a circumferential arrangement, an input terminal supported at the center of said circumferentially arranged output terminals, a rotor member of insulating material mounted upon and arranged to be rotated by said shaft member, a movable electrical contact having at least one pair of diametrically opposed tip portions rotatably mounted upon said rotor member at a location at which it is revolved by said rotor member through a circular path about the axis of said shaft member as said rotor member is rotated by said shaft member, and driving means for rotating said movable electrical contact while it is revolved about the axis of said shaft member by said rotor member, said movable electrical contact being so arranged that, as it is rotated by said driving means, each successive one of said tip portions thereof is rotated into electrical circuit relationship with the next successive one of said output terminals and the said diametrically opposed tip portion is rotated into electrical circuit relationship with said input terminal.

2. An internal combustion engine ignition distributor for sequentially directing ignition spark energy produced by an ignition coil to the spark plugs of an associated internal combustion engine comprising: a base member; a shaft member rotatably supported by said base member; a cap member of insulating material; a plurality of output terminals, each corresponding to a respective spark plug of said associated internal combustion engine, supported by said cap member in a circumferential arrangement; an input terminal supported by said cap member at the center of said circumferentially arranged output terminals; a rotor member of insulating material mounted upon and arranged to be rotated by said shaft member; a movable electrical contact having at least one pair of diametrically opposed tip portions rotatably mounted upon said rotor member at a location at which it is revolved by said rotor member through a circular path about the axis of said shaft member as said rotor member is rotated by said shaft member, and driving means including an internal ring gear supported by said cap in driving engagement with said movable electrical contact for rotating said movable electrical contact while it is revolved about the axis of said shaft member by said rotor member, said movable electrical contact being so arranged that, as it is rotated by said driving means, each successive one of said portions thereof is rotated into electrical circuit relationship with the next successive one of said output terminals and the said diametrically opposed tip portion is rotated into electrical circuit relationship with said input terminal.

3. An internal combustion engine ignition distributor for sequentially directing ignition spark energy produced by an ignition coil to the spark plugs of an associated internal combustion engine comprising: a base member; a shaft member rotatably supported by said base member; a cap member of insulating material; a plurality of output terminals, each corresponding to a respective spark plug of said associated internal combustion engine, supported by said cap member in a circumferential arrangement; an input terminal supported by said cap member at the center of said circumferentially arranged output terminals; a rotor member of insulating material mounted upon and arranged to be rotated by said shaft member; a movable electrical contact including at least one pair of diametrically opposed tip portions supported by a hub member rotatably mounted upon said rotor member at a location at which it is revolved by said rotor member through a circular path about the axis of said shaft member as said rotor member is rotated by said shaft member, and driving means including an internal ring gear supported by said cap member in driving engagement with said hub member for rotating said movable electrical contact while it is revolved about the axis of said shaft member by said rotor member, said movable electrical contact being so arranged that, as it is rotated by said driving means, each successive one of said tip portions thereof is rotated into electrical circuit relationship with the next successive one of said output terminals and the said diametrically opposed tip portion is rotated into electrical circuit relationship with said input terminal.

4. An internal combustion engine ignition distributor for sequentially directing ignition spark energy produced by an ignition coil to the spark plugs of an associated internal combustion engine comprising: a base member; a shaft member rotatably supported by said base member; a cap member of insulating material; a plurality of output terminals, each corresponding to a respective spark plug of said associated internal combustion engine, supported by said cap member in a circumferential arrangement; an input terminal supported by said cap member at the center of said circumferentially arranged output terminals; a rotor member of insulating material mounted upon and arranged to be rotated by said shaft member; a movable electrical contact including at least one pair of diametrically opposed tip portions supported by a hub member having external gear teeth in the form of a spur gear rotatably mounted upon said rotor member at a location at which it is revolved by said rotor member through a circular path about the axis of said shaft member as said rotor member is rotated by said shaft member, and driving means including gear teeth molded into said cap member in the form of an internal ring gear in driving engagement with said gear teeth of said hub member for rotating said movable electrical contact while it is revolved about the axis of said shaft member by said rotor member, said movable electrical contact being so arranged that, as it is rotated by said driving means, each successive one of said tip portions thereof is rotated into electrical circuit relationship with the next successive one of said output terminals and the said diametrically opposed tip portion is rotated into electrical circuit relationship with said input terminal.

5. An internal combustion engine ignition distributor for sequentially directing ignition spark energy produced by an ignition coil to the spark plugs of an associated internal combustion engine comprising: a base member; a shaft member rotatably supported by said base member; a cap member of insulating material; a plurality of output terminals, each corresponding to a respective spark plug of said associated internal combustion engine, supported by said cap member in a circumferential arrangement; an input terminal supported by said cap member at the center of said circumferentially arranged output terminals; a rotor member of insulating material mounted upon and arranged to be rotated by said shaft member; a movable electrical contact including two pair of diametrically opposed tip portions supported by a hub member having external gear teeth in the form of a spur gear rotatably mounted upon said rotor member at a location at which it is revolved by said rotor member through a circular path about the axis of said shaft member as said rotor member is rotated by said shaft member, and driving means including gear teeth molded into said cap member in the form of an internal ring gear in driving engagement with said gear teeth of said hub member of rotating said movable electrical contact while it is revolved about the axis of said shaft member by said rotor member, said movable electrical contact being so arranged that, as it is rotated by said driving means, each successive one of said tip portions thereof is rotated into electrical circuit relationship with the next successive one of said output terminals and the said diametrically opposed tip portion is rotated into electrical circuit relationship with said input terminal.

* * * * *

UNITED STATES PATENT AND TRADEMARK OFFICE

CERTIFICATE OF CORRECTION

PATENT NO. : 3,998,196

DATED : December 21, 1976

INVENTOR(S) : Ronnalee House

It is certified that error appears in the above-identified patent and that said Letters Patent are hereby corrected as shown below:

Col.4,line 14, "7" should read -- 27 --.
Col. 5, line 37, after "said" insert -- tip --.
Col. 6, line 59, "of" (second occurrence) should read -- for --;
line 67, "opposted" should read -- opposed --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*